United States Patent [19]

Müller et al.

[11] Patent Number: 4,737,202

[45] Date of Patent: Apr. 12, 1988

[54] METHOD OF PRODUCING STEEL COMPONENTS THAT SIMULTANEOUSLY HAVE HIGH STRENGTH AND HIGH DUCTILITY AND WHICH RETAIN THESE PROPERTIES EVEN AFTER A HOT FORMING OPERATION

[75] Inventors: Hans Müller, Dormitz; Max Albert, Nürnberg, both of Fed. Rep. of Germany

[73] Assignee: M A N Nutzfahrzeuge GmbH, Nürnberg, Fed. Rep. of Germany

[21] Appl. No.: 909,744

[22] Filed: Sep. 19, 1986

[30] Foreign Application Priority Data

Sep. 19, 1985 [DE] Fed. Rep. of Germany ..... 3533493
Aug. 20, 1986 [DE] Fed. Rep. of Germany ..... 3628264

[51] Int. Cl.[4] ..... C21D 1/68
[52] U.S. Cl. ..... 148/12.4; 148/149; 148/152
[58] Field of Search ..... 148/12.4, 143, 145, 148/149, 152

[56] References Cited

U.S. PATENT DOCUMENTS

| | | | |
|---|---|---|---|
| 2,879,192 | 3/1959 | Gogan | 148/149 |
| 3,418,178 | 12/1968 | Kulin et al. | 148/143 |
| 3,806,378 | 4/1974 | Bramfitt et al. | 148/12.4 |
| 3,902,927 | 9/1975 | Pernstal | 148/12.4 |
| 4,329,188 | 5/1982 | Wang | 148/143 |

FOREIGN PATENT DOCUMENTS

| | | | |
|---|---|---|---|
| 31102 | 3/1980 | Japan | 148/145 |

*Primary Examiner*—L. Dewayne Rutledge
*Assistant Examiner*—George Wyszomierski
*Attorney, Agent, or Firm*—Becker & Becker, Inc.

[57] ABSTRACT

A steel with a carbon content of less than 0.3 percent by weight is used for steel-based components which are subjected to hot forming. A predominantly lower bainite structure is achieved by controlled cooling. The advantage is that components, such as truck steering knuckles, which are forged at temperatures of up to about 1300° C., no longer need be subjected to annealing or tempering after cooling in order to possess good ductility in addition to high strength.

9 Claims, No Drawings

METHOD OF PRODUCING STEEL COMPONENTS THAT SIMULTANEOUSLY HAVE HIGH STRENGTH AND HIGH DUCTILITY AND WHICH RETAIN THESE PROPERTIES EVEN AFTER A HOT FORMING OPERATION

FIELD OF THE INVENTION

1. Background of the Invention

The present invention relates to a method of producing steel components that simultaneously have high strength and high ductility or toughness, and which retain these properties even after a hot forming or forging operation.

2. Description of the Prior Art

Steels have the property, after heat treatment, of displaying a high strength, but insufficient ductility, unless they are annealed, tempered, or drawn at a suitably high temperature. For many components, such as the steering knuckles or axle spindles of trucks, it is desirable that high strength be combined with sufficient ductility of the material.

An object of the present invention therefore is to produce steel-based components according to which, after a hot forming operation above the transformation temperature, the material possesses a good ductility in addition to high strength without any special post annealing or tempering. In conformity with this object, these properties are also to be obtained after prior cooling and reheating, or only after heating above the transformation temperature of a component.

SUMMARY OF THE INVENTION

Pursuant to the present invention, this object is realized by a method characterized primarily in that:

(a) the steel possesses a carbon content of less than 0.3 percent by weight, and (b) the cooling rate is controlled in such a way that a predominantly lower bainite structure is produced.

A method of this type has the advantage that components, such as the steering knuckles of trucks, possess a predominantly lower bainite structure whereby good ductility is associated with high strength despite forging operations at temperatures up to about 1300° C. (hot forming), even without subsequent special heat treatment, such as annealing or tempering.

In producing components with the initially defined desired properties, the steel used according to the present invention is one with a carbon content of less than 0.3 percent by weight.

This calls for the cooling rate to be controlled in such a way that predominantly lower bainite structure is obtained. The desired cooling method depends essentially on the geometric dimensions of the component. Known methods of cooling may be used for this purpose, such as cooling in still air, moving air, spray mist of a coolant, oil bath, salt bath, fluidized-bed cooling, water with additions of salt or lye, to name only a few examples.

In contrast to conventional intermediate stage tempering or austempering (to achieve a bainite microstructure), where quenching (cooling) is applied down to a predetermined temperature which is above the martensite-forming temperature, with this temperature then being maintained until the austenite has been transformed into bainite, cooling is continuosuly undertaken in the intermediate stage of the inventive method.

In order to further improve the microstructure of the bainite, it is possible to add microalloying elements such as Nb and/or also Ti, Zr or V and even Al (the latter however only in conjunction with one of the aforementioned elements). As a result of these alloying elements, grain growth, with all its well-known negative effects, is kept within limits by carbide, nitride or carbonitride formation during hot forming of such a component, despite working temperatures of up to about 1300° C., and/or direct crystallization as well as grain coarsening after hot forming are suppressed or retarded.

A specially fine-grained structure is obtained if the structure is subjected to a thermomechanical treatment at appropriately low temperatures, such as forging or rolling.

In an advantageous further development of the invention, bainite-forming elements, such as Mn, B and Mo, may be added. With appropriate control of the cooling rate, this represses the formation of martensite, upper bainite, and ferrite/pearlite, which have a negative effect on the ductile and/or strength properties.

Since a component having areas of different cross-sections, when subjected to cooling, will cool faster in the thinner cross-sections and slower in the thicker cross-sections, it is necessary to provide selective control of the cooling rate in the individual areas. This is effected by special quenching systems which either slow down the quenching rate at the thinner cross-sections or accelerate the rate at the thicker cross-sections. It is also possible to provide for the thinner cross-sections to be quenched in a separate cooling operation prior to the thicker cross-sections either into the bainite structure or into a ferrite/pearlite structure (where high stress levels are not specified) before the thicker cross-section of the component is cooled to such an extent that it is no longer austenitic.

Another advantage of the method according to the present invention consists in the possibility of producing a bainite structure selectively, for instance only in the rim zones of the workpieces which are subjected to high stresses. This permits different strength levels (depending on requirements) to be selectively produced in the individual sections of the component.

Projections or thin-walled zones on the outside or also inside a workpiece can be treated in different ways. For instance, these areas can be masked by means of a heat-insulating cover prior to quenching, or these areas can be subjected to controlled cooling prior to quenching (for example by directing a spray of mist of a cooling medium selectively at these areas). In the process, these areas are cooled differently under controlled conditions down to a level below the transformation temperture so that, after immersion in the bath, no hardening takes place in these areas. Alternatively, it is possible to first cover the aforementioned projections or areas by formed parts, and to then apply the spray of a cooling medium to only the relevant areas of the workpeice for controlled cooling. As a further development of the inventive concept, it is finally proposed that the formed pieces be removed when temperature equalization has been reached between the thin-walled and thick-walled areas of the workpiece, but at the latest before the temperature decreases below the transformation temperature of the steel, and that the formed pieces then be directly exposed to the spray of the cooling medium.

EXAMPLE

Using a steel as prescribed, for example 15 CrMo 5, it was possible, for instance in round stock of 70 mm diameter, to verify values, measured at a distance of $\frac{1}{3}$ of the radius from the outside, which exceed the minimum values of a 42 CrMo 4 steel according to DIN (German Industrial Standard) 17200, with Rm $=1139$ N $mm^{-2}$, Rp $0.2=964$ N $mm^{-2}$, and Av$=54$ J, where Rm is the tensile strength, Rp the 0.2% offset proof stress or yield strength, and Av the notched bar impact test energy.

The present invention is, of course, in no way restricted to the specific disclosure of the specification, but also encompasses any modifications within the scope of the appended claims.

What we claim is:

1. A method of producing steel components that have both high strength and high ductility, and that retain these properties even after a hot forming operation; said method includes the steps of:

utilizing steel having a carbon content of less than 0.3% by weight;

heat treating said steel;

cooling said steel, including controlling the cooling rate of said steel in such a way that a predominantly lower bainite structure is produced;

covering projections of thin-walled areas of said component, on the outside of or within the latter, with formed parts, and then subjecting only the thin-walled areas of said component to a controlled cooling by applying the spray of a cooling medium thereto, at the latest before the temperature drops below the transformation temperature of said steel, of removing said formed parts, and then exposing said projections and thin-walled areas directly to the spray of said cooling medium.

2. A method according to claim 1, which includes the step of adding to said steel at least one micro-alloying element of the type that forms at least one of the group consisting of carbides, nitrides, and carbonitrides.

3. A method according to claim 2, in which said micro-alloying elements are selected from the group consisting of Nb, Ti, Zr, V, Al with the latter however only in conjunction with one of the aforementioned elements, and mixtures thereof.

4. A method according to claim 1, which includes the step of subjecting said structure to a thermo-mechanical treatment.

5. A method according to claim 4, in which said thermo-mechanical treatment includes forging or rolling.

6. A method according to claim 1, which includes the step of adding to said steel at least one bainite-forming element.

7. A method according to claim 6, in which said bainite-forming elements are selected from the group consisting of Mn, B, and Mo.

8. A method according to claim 1, which includes the step, prior to said cooling step, of selectively masking projections or thin-walled areas of said component, on the outside of or within the latter, with heat-insulating cover means.

9. A method according to claim 1, which includes the step, prior to said cooling step, of subjecting projections or thin-walled areas of said component, on the outside of or within the latter, to a controlled cooling by selectively directing a spray mist of cooling medium onto these projections and thin-walled areas.

* * * * *